US005553632A

United States Patent [19]

Burkhardt

[11] Patent Number: 5,553,632

[45] Date of Patent: Sep. 10, 1996

[54] HAIR STYLING DEVICE

[76] Inventor: Charles W. Burkhardt, 285 Cape Royale, Coldspring, Tex. 77331

[21] Appl. No.: 397,905

[22] Filed: Mar. 3, 1995

[51] Int. Cl.[6] ..... A45D 20/48

[52] U.S. Cl. ..... 132/271; 132/144; 132/148; 34/101; 34/97; 219/225

[58] Field of Search ..... 132/148, 144, 132/271, 138; 34/97, 101; 119/85; 219/222, 225

[56] References Cited

U.S. PATENT DOCUMENTS

| | | | |
|---|---|---|---|
| 2,576,368 | 7/1949 | Steiner | 132/14 |
| 2,859,754 | 7/1957 | Futterer | 132/145 |
| 3,265,075 | 8/1966 | Edman et al. | 132/9 |
| 3,538,617 | 3/1968 | Walters | 34/97 |
| 3,939,850 | 2/1976 | Wahl | 132/11 |
| 3,949,756 | 4/1976 | Vallis | 132/11 |
| 4,423,531 | 1/1984 | Wall | 15/187 |
| 4,471,791 | 9/1984 | DeRoche | 132/271 |
| 4,538,362 | 9/1985 | Andis | 34/97 |
| 4,590,687 | 5/1986 | Caruso | 34/97 |
| 4,629,863 | 12/1986 | Giordano | 219/373 |
| 4,759,135 | 7/1988 | Scivoletto | 34/97 |
| 4,827,105 | 5/1989 | Brown, Jr. | 219/373 |
| 4,955,145 | 9/1990 | Scivoletto | 132/271 |
| 5,091,630 | 2/1992 | Djuric | 132/271 |
| 5,212,366 | 4/1993 | McDougall | 219/222 |
| 5,400,809 | 3/1995 | Adams | 34/101 |
| 5,435,327 | 7/1995 | Ho | 132/271 |
| 5,449,007 | 9/1995 | Aruhols | 132/144 |
| 5,467,540 | 11/1995 | Bastien | 34/97 |

*Primary Examiner*—John G. Weiss
*Attorney, Agent, or Firm*—Pravel, Hewitt, Kimball & Krieger

[57] ABSTRACT

A hair styling device for providing lift by directing air flow from a blow dryer to a selected section of hair adjacent the scalp while holding the hair in position away from the scalp, which includes a nozzle type blow dryer attachment having a pair of combs mounted adjacent one side of attachment's opening so that the air stream directed by the nozzle flows alongside the length of the comb teeth. The pair of combs can be moved laterally relative to one another the teeth of one comb can be moved into and out of engagement with the adjacent teeth of the other comb. By moving the teeth into engagement, hair can be held in position away from the scalp while blow drying so that the hair between the scalp and the comb teeth can be dried while in the upstanding position to provide lift to hair styles.

7 Claims, 3 Drawing Sheets

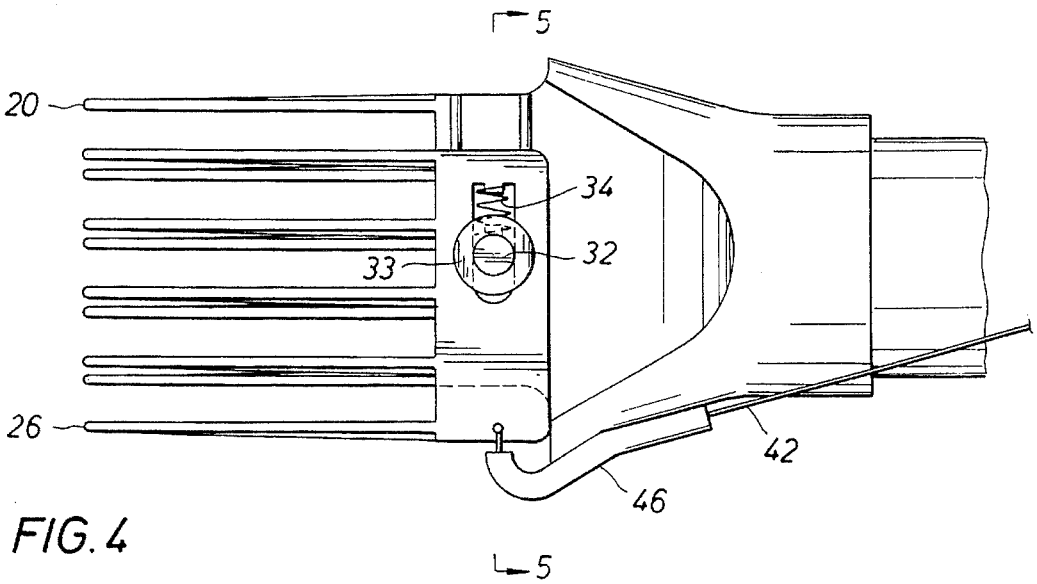
FIG. 4
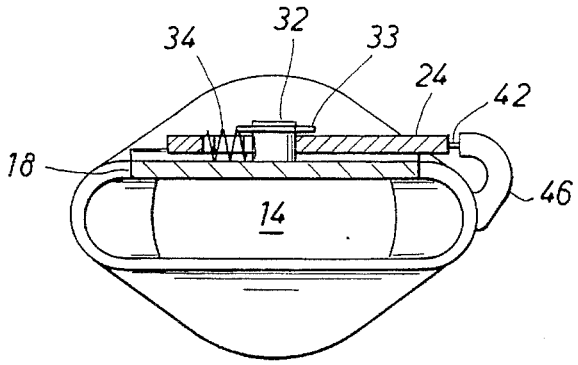
FIG. 5
FIG. 6
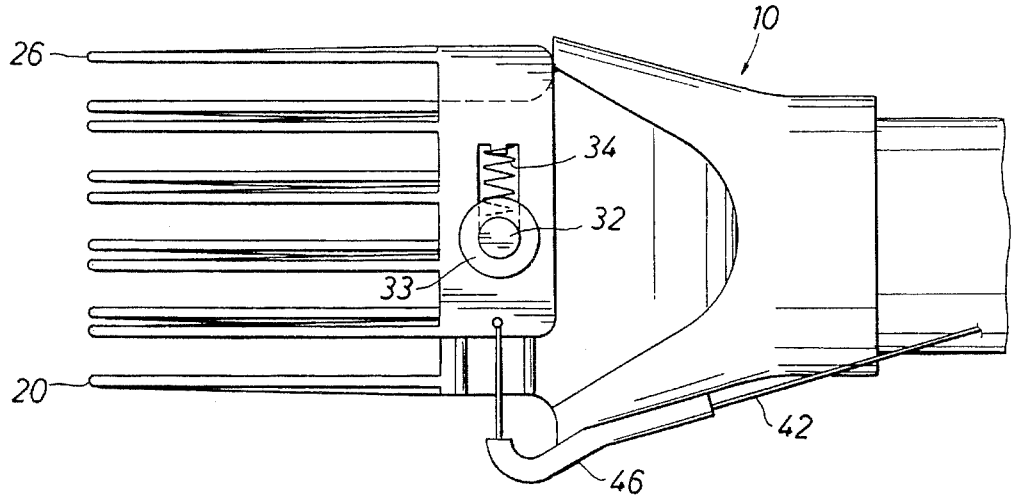

HAIR STYLING DEVICE

FIELD OF THE INVENTION

The invention relates to a hair styling device and in particular to a device for holding hair in a desired position while blow drying or heat styling hair.

BACKGROUND OF THE INVENTION

The prevalent hair styling methods today are blow drying and hot curling. It is well known that heat applied to either wet or dry hair causes the hair to maintain the shape that it had during the time it was being heated. For this reason, various devices and methods have been available for shaping hair sections while either blow drying the section or hot curling or straightening the section.

To create lift or body in a hair style, it is important to dry the hair adjacent the scalp first while it is held away from the scalp. Good lift or body can be achieved if about a one inch length of hair out from the scalp is heated and/or dried first, while the hair is held in position extending out from the scalp. To accomplish this task, however, requires keeping the hair in that position while directing the heat and drying effect primarily to that portion of hair only. The higher the heat, the more effective it is to set the hair so that it maintains its position away from the scalp. However, a high heat directed toward the scalp creates discomfort. It would therefore be desirable to be able to hold the hair in position while directing the hot air either away from the scalp or across the scalp, rather than directly toward the scalp. Although this might be accomplished by holding the hair in position with the fingers of one hand while directing a blow dryer tangentially to the scalp, this requires the use of both hands for styling. In addition, the fact that hot air is then directed at the fingers holding the hair can make the fingers uncomfortably hot.

Numerous blow dryer attachments have been marketed as aiding in providing lift to hair styles. U.S. Pat. No. 4,955,145 to Scivolletti attempts to address the problem by providing a hair dryer nozzle attachment with a rectangular outlet opening with one long side wall forming an air deflector which has at its end a comb with each comb tooth having an attached short pick or prong extending into the deflected air stream. The air deflector is designed to concentrate the air stream and direct it perpendicularly toward the picks. However, as can be appreciated, the result is that the air is not held in position by the picks but instead is blown off of the picks by the concentrated air stream. Other hair dryer attachments which include teeth extending parallel to the air stream suffer from the same problem. If the air stream is aimed tangentially to the scalp, then the air blows the hair out of position before it can be dried by the air stream. If the air stream is directed toward the scalp, then the air blows the hair against the scalp creating a flattened rather than lifted hair style and further causing scalp discomfort if a relatively hot stream is used.

The present invention addresses both the hot scalp and lifting position problems by providing a device that both holds the hair in the necessary position away from the scalp and directs the hot air stream directly toward the portion of hair adjacent the scalp rather than toward the scalp itself.

SUMMARY OF THE INVENTION

The invention provides a hair styling device which can either be designed as an attachment for a blow dryer or integrated within a blow dryer. The device in its broadest sense consists of two sets of comb teeth which can be moved into and out of engagement with one another for gently gripping a portion of hair adjacent the scalp to hold that portion in a desired position while applying air to that portion between the scalp and the gripped hair.

One embodiment of the invention includes a nozzle for attachment over the air exit port of a hair dryer with a pair of combs mounted to one side of the exit port of the nozzle attachment. The combs are mounted for lateral movement relative to one another by a spring which can be compressed by pulling on a cable attached to one of the comb bases. A suitable trigger is provided for selectively pulling on the cable to alternately engage and disengage adjacent teeth of the separate combs.

Other aspects and features of the invention will be more readily apparent in light of the foregoing figures and the detailed description of various illustrative embodiments which follow.

BRIEF DESCRIPTION OF THE DRAWINGS

FIG. 4 is a view similar to FIG. 3 showing the attachment of FIG. 1 in a non-hair holding position.

FIG. 5 is a cross sectional view along line 5—5 of FIG. 4.

FIG. 6 illustrates an alternative embodiment showing the attachment in a non-hair holding position.

DETAILED DESCRIPTION OF EMBODIMENTS

Figure 1:
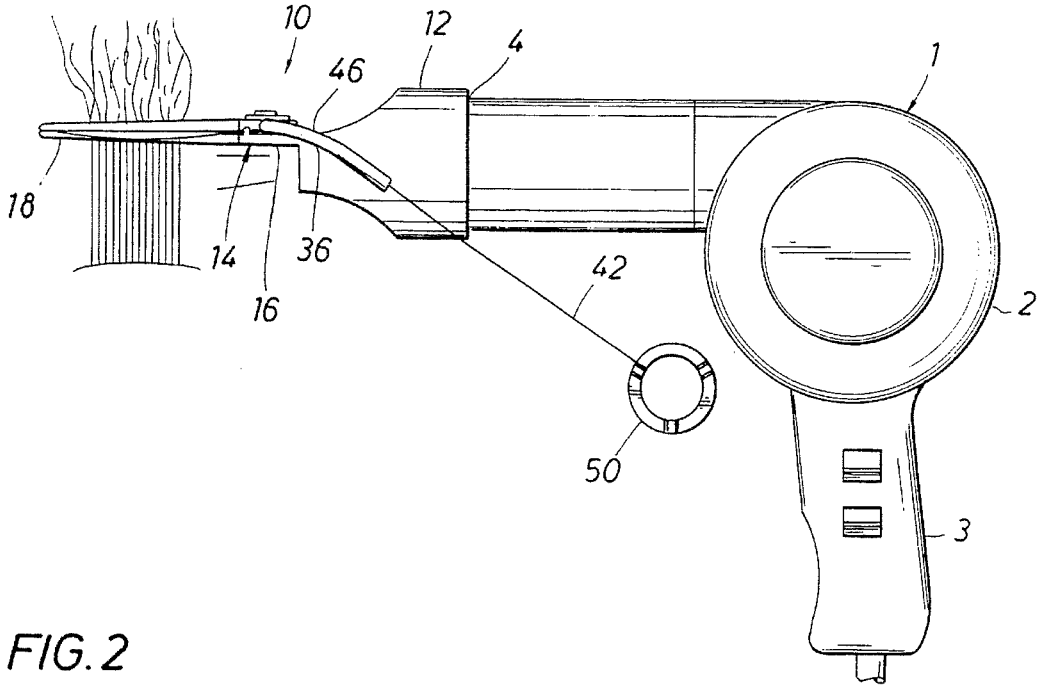
FIG. 1 is a side view of an embodiment of the invention mounted on a hair dryer illustrating its use for gripping hair while blow drying to create hair style lift.

With reference to the drawings, FIG. 1 shows an embodiment of the invention in use with a typical pistol grip blow dryer 1. The blow dryer 1 includes a motor housing 2, handle 3 and nozzle end 4. The embodiment of the invention shown in FIG. 1 is designated as attachment 10 and includes a nozzle portion 12 for fitting over the nozzle end 4 of the dryer 1 to reduce the air exit port from its circular opening to a more narrow rectangular opening 14.

Secured to one long face of nozzle opening 14 are a pair of combs having widely spaced teeth and mounted for lateral movement relative to one another so that adjacent inward faces of the teeth of each comb can be moved into and out of engagement with one another as will be more fully understood in light of the following discussion.

The pair of moveable combs includes a first comb 16 having a base 18 with a plurality of teeth 20 extending from its base 18. The second comb 22 also includes a base 24 with similarly constructed teeth 26.

Figure 2:
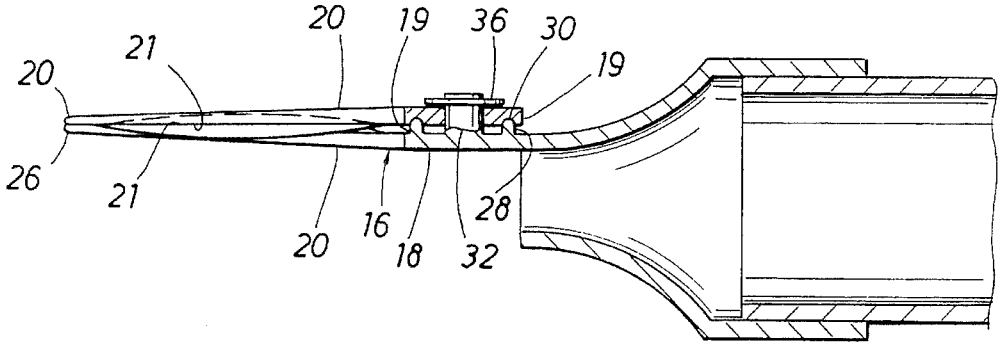
FIG. 2 is an enlarged side cross sectional view of the embodiment of FIG. 1.

In the illustrated embodiment, the means for moving the combs laterally relative to one another includes providing a sliding track between the bases of the respective combs and a spring mounted to a pin and contained in a space between the bases of the combs. As best shown in FIG. 2, the base 18 of the first comb has a pair of ridges 28 formed on its internal face for sliding within a pair of corresponding notches or depressions 30 formed in the internal face of the second comb's base 24.

As best shown in FIG. 2, the two combs are secured together for lateral movement relative to one another by a pin and flange arrangement. In particular, pin 32 is secured to one of the comb bases, e.g. the first comb base 18, and extends through the a clearance hole in second base 24. A suitable cap, which can be a threaded nut or formed flange 33 is provided to loosely secure the second base 24 atop the first base 18 for sliding movement in the tracks formed by the first comb base ridges 28 and the second comb base notches 30.

The illustrated embodiment of a moving mechanism is best shown in FIGS. 3, 4, 5 and 6, where a spring 34 is shown mounted for compression between the two comb bases 18 and 24. One end of the spring 34 can conveniently be secured to the pin 32, which also serves as a first spring stop on the first base 18. A second spring stop can conveniently be provided by forming a cutout 38 in the second base 24 with an end wall of the cutout 38 including a slight protrusion or extension 36 for securing the second end of the spring 34.

In order to move the combs relative to one another, in the illustrated embodiment, cable 42 is shown attached to the base 24 at 44. A cable housing or sleeve 46 is secured to the nozzle 12 to contain and direct the cable 42 generally toward the hair dryer handle 3.

Figure 7:
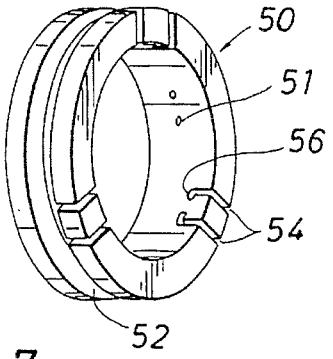
FIG. 7 is an enlarged prospective view of the ring type trigger mechanism shown in FIG. 1.
Figure 8:
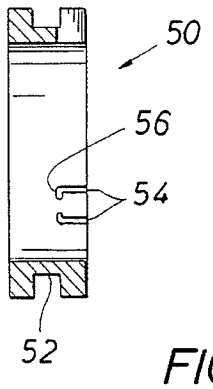
FIG. 8 is a side view, partly in cross section, of the ring type trigger mechanism shown in FIGS. 1 and 7.

With reference to FIGS. 1, 7, and 8, one mechanism to enable the user to pull the cable 42 with the same hand that is gripping the dryer handle 3 is a ring 50. As best shown in FIGS. 7 and 8, one or more holes 51 are provided through the ring for securing the end of the cable 42 to the ring 50, e.g. by threading the end through the hole and knotting the end. To enable the attachment 10 to be used with any size or style of dryer, and to locate the ring in an appropriate position for the size of the particular user's hand, the ring 50 can conveniently be provided with an annular notch 52 and several pairs of radial notches 54. With this arrangement, excess cable length can be wound around the ring 50 within the annular notch 52 and then secured by placing the loose end about one of the radial notch pairs, then securing the end by pulling it into a notch extension 56.

Figure 11:
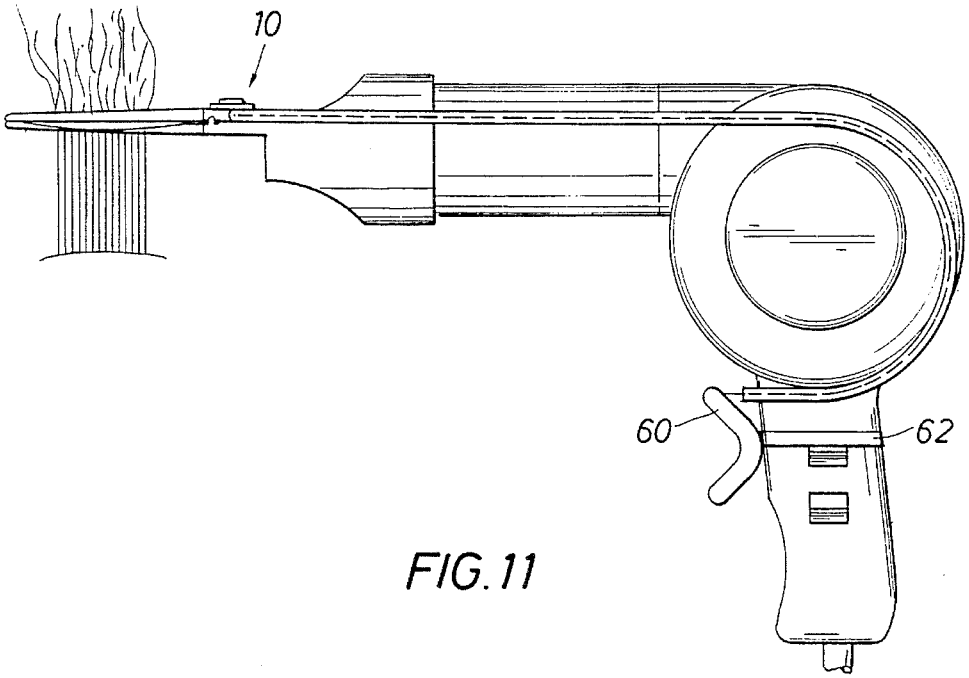
FIG. 11 illustrates an alternative embodiment of the invention incorporating a trigger and cable mechanism.

An alternative mechanism for moving the combs laterally relative to one another is shown in FIG. 11. Instead of a ring, a pull cable can be connected to a trigger 60. The trigger 60 can be provided with any suitable means for securing it to the dryer handle 3, such as by a flexible elastic strap or adjustable band 62. Although somewhat more complicated and less flexible for the user, the trigger 60 has the advantage of assuring that only enough tension will be placed on the cable to close the comb teeth to hold the hair.

Figure 3:
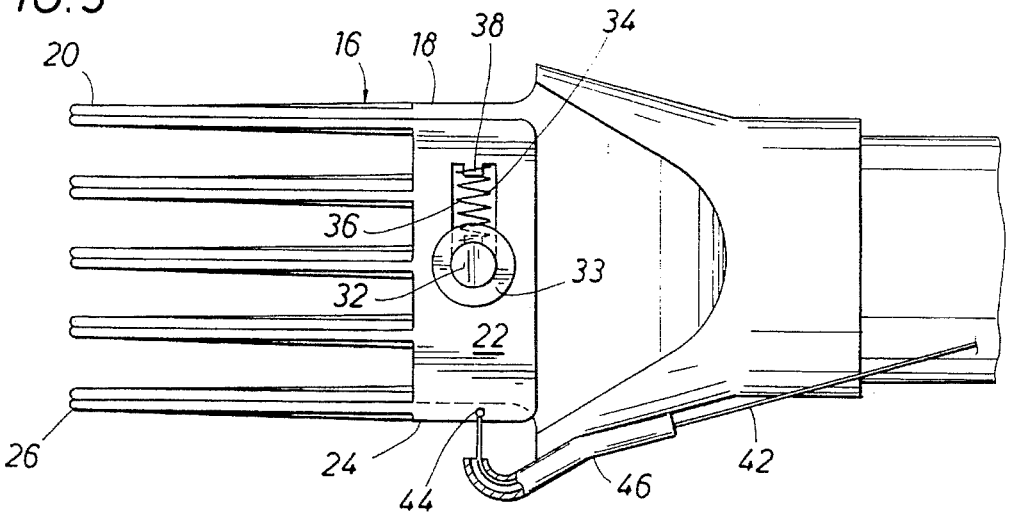
FIG. 3 is a top view of the attachment of FIG. 1, partly in cross section, showing the attachment in position for holding hair, with portions removed to reveal the internally mounted spring.

As can now be appreciated, by providing a mechanism for moving the first and second combs laterally relative to one another, adjacent teeth on the two combs can be moved into engagement, as shown in FIG. 3 and out of engagement as shown in FIGS. 4 and 6. In either position the combs can act as a normal comb and be used to comb through the hair with or without the application of air and heat from the dryer. However, as the combs are passed through the hair, moving the teeth into the position shown in FIG. 3 captures the hair between the teeth so that it can be held in position relative to the scalp while heat and air are being applied. For purposes of selectively and first drying the portion of hair adjacent the scalp to provide hair style lift, with the comb teeth separated, the attachment can be used as a comb to comb the hair out from the scalp, then the combs moved so that the teeth hold the hair in its desired position, then the dryer turned on to selectively apply hot air to this important lift creating hair section before drying the remaining length of the hair.

The spring and location of the cable attachment to a comb base can be arranged so that the combs are either normally in a holding position as shown in FIGS. 3 and 4, or normally in a non-holding position as shown in FIG. 6. With the FIG. 6 arrangement, once the hair is combed into position, pulling the ring 50 or trigger 60 holds the hair and the dryer can be turned on to selectively dry the held hair. With the FIG. 3 arrangement, pulling the ring or trigger opens the teeth for combing and releasing the trigger permits them to close to hold the hair in position for drying.

As can now be appreciated, the invention provides a device which is simple to operate with one hand to hold a section of hair away from the head while directing hot air over only the portion of hair adjacent the scalp and not directly on the scalp.

Although illustrated with the plane of the comb teeth perpendicular to the dryer handle, it is an advantageous feature of the invention that the comb teeth can be oriented in any plane relative to the dryer handle. For example, the orientation shown in FIG. 1 is best for creating lift on the top of the head. For other portions, the attachment nozzle 12 can simply be rotated relative to the dryer nozzle 4 to achieve a comfortable position of the hand gripping the nozzle relative to the hair section being styled. For example, if a hair stylist is using the invention, the attachment can be rotated so that the dryer handle is perpendicular to the plane of the combs for working on hair sections on the sides and back of the head. If a person is styling his own hair, it might be easier to have the handle angled relative to the attachment rather than perpendicular.

Although the invention has been described in detail with reference to particular mechanical parts and arrangements of parts, numerous variations and modifications could be made depending on desired durability and manufacturing costs. For example, improved durability might be achieved by incorporating within the housing of a blow dryer the means for moving the comb teeth into and out of engagement. This would avoid the need to have an external, detachable cable and detachable trigger. If the invention were integral to a blow dryer, then, in addition, the mechanism for moving the teeth relative to one another could be either mechanical or electrical, with the movement trigger being incorporated into the switch which turns the air blower on and off. In this manner, the teeth could be arranged to be in a gripping position when the dryer was blowing, and not gripping when the dryer was off. With an integral mechanism, as with the illustrated attachment embodiment, the mechanism could be arranged either to open when the trigger is pulled such as shown in FIGS. 3 and 4, or to close when the ring or trigger is pulled, as shown in FIG. 6.

Figure 9:
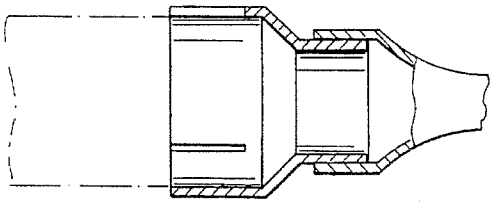
FIG. 9 (PRIOR ART)
FIG. 9 illustrates a rigid nozzle adapter suitable for use with the invention.
Figure 10:
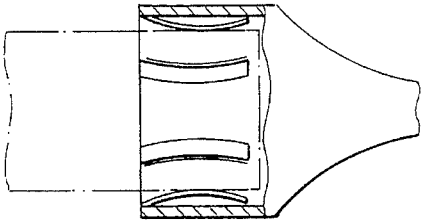
FIG. 10 (PRIOR ART)
FIG. 10 illustrates an alternative nozzle size adapter suitable for use with the invention.

Although the invention works well with smooth comb teeth, if more gripping force is desired, the mating surfaces of the comb teeth could be provided with a slightly tacky or roughened surface, or with ridges. Although illustrated with a nozzle attachment sized to precisely fit over a blow dryer nozzle, as can be appreciated, the nozzle attachment could be of a more universal type by providing either an extra size adapter for going from a smaller size to a larger sized dryer nozzle such as shown in FIG. 9 or by providing flexible prongs or fingers inside the nozzle attachment bore as shown in FIG. 10.

Various other modifications could be made without departing from the spirit of the invention, the scope of which is defined by the following claims.

What is claimed is:

1. A hair styling device for use with a blow dryer comprising:

a nozzle having a first end for attachment over the air exit port of a hair dryer and a second end defining a nozzle exit port;

a first comb having a base portion and a toothed portion wherein the first comb is secured to the nozzle such that the toothed portion extends outwardly alongside said nozzle exit port;

a second comb substantially similar to the first comb, having a base portion and a toothed portion, and mounted in facing relation to the first comb for lateral movement relative to the first comb so that movement of the combs relative to one another causes the teeth of the toothed portions to engage and disengage along at least a portion of their facing edges; and a mechanism for selectively moving at least one of the pair of combs relative to the other to cause adjacent teeth on the respective combs to selectively engage and disengage.

2. The device of claim 1 wherein the selectively moving mechanism includes a compressible member mounted for compression and expansion between a first stop member located on the base portion of the first comb and a second stop member located on the base portion of the second comb.

3. The device of claim 2 wherein the selectively moving mechanism further includes a pull cable for selectively compressing and releasing the compressible member.

4. The device of claim 3 further comprises means for adjusting the length of the pull cable.

5. The device of claim 4 further wherein the selectively moving mechanism includes a ring secured to the distal end of the cable and wherein the cable length adjusting means includes an annular groove about the ring for retaining wound cable and a notch for securing the loose end of cable wound about the ring within the groove.

6. The device of claim 1 wherein the selectively moving mechanism includes a trigger and the device further includes means for removably mounting the trigger to a handle portion of a blow dryer.

7. A hair styling device comprising:

a hair dryer having an air exit port;

a first comb having a base portion and a toothed portion wherein the first comb is secured adjacent the air exit port such that the toothed portion extends outwardly alongside said exit port;

a second comb substantially similar to the first comb, having a base portion and a toothed portion, and mounted in facing relation to the first comb for lateral movement relative to the first comb so that movement of the combs relative to one another causes the teeth of the toothed portions to engage and disengage along at least a portion of their facing edges; and a mechanism for selectively moving at least one of the pair of combs relative to the other to cause adjacent teeth on the respective combs to selectively engage and disengage.

* * * * *